US009454112B1

(12) United States Patent
Gotoh et al.

(10) Patent No.: US 9,454,112 B1
(45) Date of Patent: Sep. 27, 2016

(54) TEMPERATURE DETECTION DEVICE, FIXING DEVICE, AND IMAGE FORMING APPARATUS

(71) Applicant: FUJI XEROX CO., LTD., Tokyo (JP)

(72) Inventors: Yasutaka Gotoh, Yokohama (JP); Koji Okabe, Yokohama (JP); Jouta Kobayashi, Yokohama (JP); Kyogo Soshi, Yokohama (JP); Yusuke Sakurai, Yokohama (JP); Hiroko Furukata, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/994,781

(22) Filed: Jan. 13, 2016

(30) Foreign Application Priority Data

Sep. 17, 2015 (JP) ..... 2015-183705

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
USPC ..... 399/69, 329
See application file for complete search history.

(56) References Cited

U.S. PATENT DOCUMENTS 7,209,696 B2 * 4/2007 Umezawa et al. . G03G 15/2064 399/329
8,295,752 B2 * 10/2012 Tomita et al. ..... G03G 15/2039 399/69

FOREIGN PATENT DOCUMENTS

JP 2004-037412 A 2/2004

* cited by examiner

*Primary Examiner* — William J Royer
(74) *Attorney, Agent, or Firm* — Oliff PLC

(57) ABSTRACT

A temperature detection device includes a supporting body that includes end portions and a middle portion and that is elastically deformed by being pressed by an object to be detected, both of the end portions being supported at positions separated from the object to be detected, the supporting body having an initial shape such that the middle portion bulges in an arc shape to a position beyond the object to be detected when the supporting body does not receive an external force from the object to be detected; and a temperature detection element that is supported by a contact portion of the supporting body that contacts the object to be detected.

9 Claims, 4 Drawing Sheets

TEMPERATURE DETECTION DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-183705 filed Sep. 17, 2015.

BACKGROUND

Technical Field

The present invention relates to a temperature detection device, a fixing device, and an image forming apparatus.

SUMMARY

According to an aspect of the invention, a temperature detection device includes a supporting body that includes end portions and a middle portion and that is elastically deformed by being pressed by an object to be detected, both of the end portions being supported at positions separated from the object to be detected, the supporting body having an initial shape such that the middle portion bulges in an arc shape to a position beyond the object to be detected when the supporting body does not receive an external force from the object to be detected; and a temperature detection element that is supported by a contact portion of the supporting body that contacts the object to be detected.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

Figure 1:
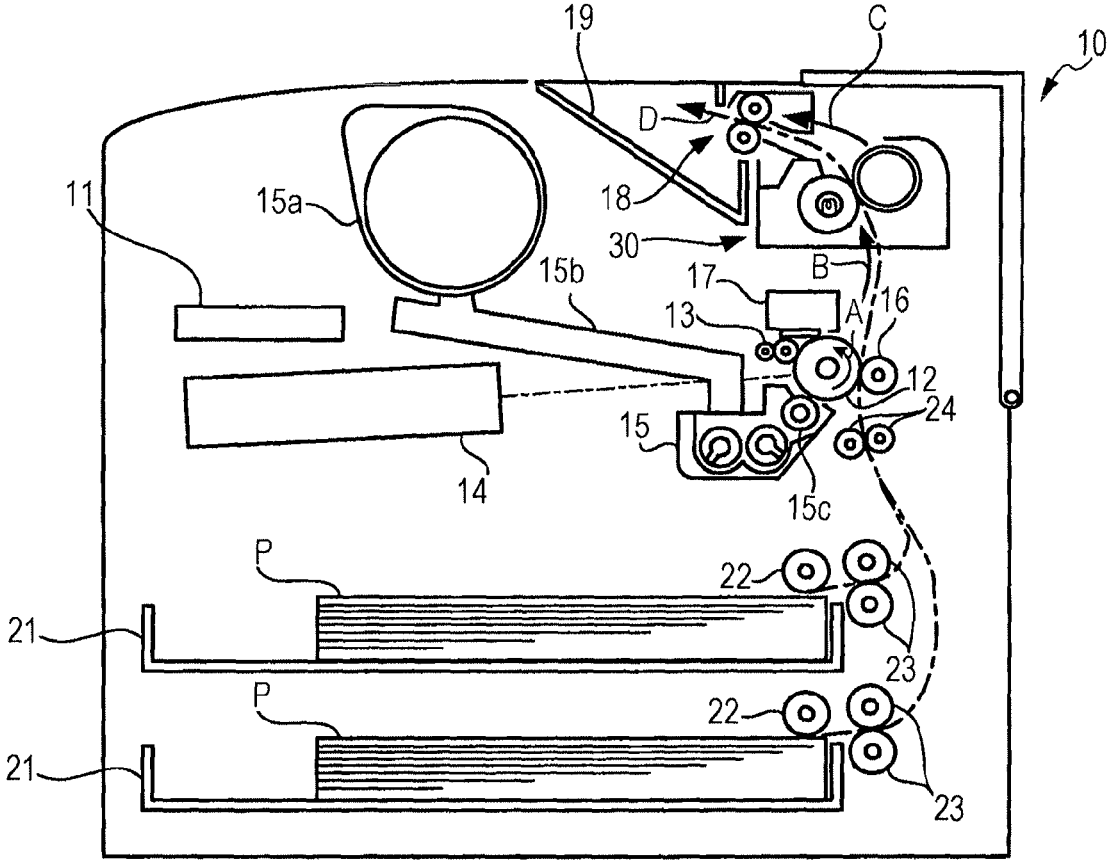
FIG. 1 is a schematic view of a printer, which is an example of an image forming apparatus according an exemplary embodiment the present invention.

FIG. 1 is a schematic view of a printer 10, which is an example of an image forming apparatus according an exemplary embodiment the present invention.

The printer 10 illustrated in FIG. 1 is a monochrome printer. The printer 10 includes an exemplary embodiment of a fixing device according to the present invention and an exemplary embodiment of a temperature detection device according to the present invention.

An image signal, which has been made by an external apparatus, is input to the printer 10 through a signal cable or the like (not shown). The printer 10 includes a controller 11 that controls various components of the printer 10. The image signal is input to the controller 11. Under the control by the controller 11, the printer 10 forms an image based on the image signal.

Two sheet trays 21 are disposed in a lower part of the printer 10. Sheets P are loaded in the sheet trays 21. The size of sheets P loaded in one of the sheet trays 21 differ from that of sheets P loaded in the other sheet tray 21. It is possible to pull out the sheet trays 21 when loading the sheets P into the sheet trays 21.

A pick-up roller 22 feeds some of the sheets P from one of the sheet trays 21 that holds the sheets P having a size that is appropriate for printing an image represented by an image signal input to the controller 11. Separation rollers 23 separate the sheets P, fed by the pick-up roller 22, into individual sheets. One of the separated sheets P is transported upward, and a leading end of the sheet P reaches registration rollers 24. The registration rollers 24 have a function of feeding the sheet P after adjusting the timing with which the sheet P is to be transported. The sheet P, which has reached the registration rollers 24, is transported further at a timing adjusted by the registration rollers 24.

The printer 10 includes a photoconductor 12, which rotates in a direction indicated by an arrow A, above the registration rollers 24. A charging unit 13, an exposure unit 14, a developing unit 15, a transfer unit 16, and a photoconductor cleaner 17 are disposed around the photoconductor 12.

The photoconductor 12 has a cylindrical shape extending in the direction perpendicular the plane of FIG. 1. The photoconductor 12 holds charges when it is charged and releases some of the charges when it is exposed to light, and thereby an electrostatic latent image is formed on the surface of the photoconductor 12.

The charging unit 13 includes a charging roller that rotates while contacting the surface of the photoconductor 12. The charging roller charges the surface of the photoconductor 12 by supplying charges to the surface. Instead of being a charging unit having a charging roller, the charging unit 13 may be a corona charging unit that charges the photoconductor 12 without contacting the photoconductor 12.

The exposure unit 14 includes a light emitter and a rotary polygon mirror. The light emitter emits a laser beam (exposure light) that is modulated in accordance with an image signal supplied from the controller 11. The rotary polygon mirror scans the photoconductor 12 with the laser beam. When the photoconductor 12 is exposed to the exposure light emitted from the exposure unit 14, an electrostatic latent image is formed on the surface of the photoconductor 12. Instead of being an exposure unit that uses a laser beam, the exposure unit 14 may be an LED array in which multiple LEDs are arranged in a scanning direction. A latent image may be formed by using a method other than the exposure method, such as a method of directly forming a latent image by using multiple electrodes that are arranged in the scanning direction.

The developing unit 15 develops the electrostatic latent image, which is formed on the surface of the photoconductor 12 exposed to light. A toner container 15*a* is connected to the developing unit 15 through a toner supply path 15*b*. A developer, which is composed of a toner and a magnetic carrier, is contained in the developing unit 15. The toner is contained in the toner container 15*a* and supplied to the developing unit 15 through the toner supply path 15*b* as necessary. The magnetic carrier is, for example, iron powder that is composed of particles whose surfaces are coated with a resin. The toner is composed of particles that are made of, for example, a binder resin, a colorant, and a release agent. The developing unit 15 charges the toner and the magnetic carrier by agitating the developer, which is a mixture of the toner particles and the magnetic carrier particles. The developing unit 15 includes a development roller 15*c* that supplies the developer in the developing unit 15 to the photoconductor 12. The developing unit 15 forms a toner image by developing the latent image on the surface of the photoconductor 12 by using the charged toner in the developer.

The registration rollers 24 feed the sheet P so that the sheet P reaches a position facing the transfer unit 16 at the same time as the toner image on the photoconductor 12 reaches the position. The transfer unit 16 transfers the toner image on the photoconductor 12 to the sheet P, which has been fed to the position. The transfer unit 16 may be a device including an intermediate transfer member. In this case, a toner image on the photoconductor 12 is temporarily transferred to the intermediate transfer member, and the toner image on the intermediate transfer member is transferred to the sheet P.

The photoconductor cleaner 17 removes, from the photoconductor 12, toner that remains on the photoconductor 12 after the toner image has been transferred to the sheet P.

The photoconductor 12, the charging unit 13, the exposure unit 14, the developing unit 15, and the transfer unit 16 correspond to an example of an image forming device according to the present invention.

The sheet P, to which the toner image has been transferred, is transported further in a direction indicated by an arrow B. A fixing unit 30 heats and presses the sheet P to fix the toner image onto the sheet P. As a result, an image, which is a fixed toner image, is formed on the sheet P. The fixing unit 30 corresponds to a fixing device according to an exemplary embodiment of the present invention. As described below, the fixing unit 30 includes an exemplary embodiment of a temperature detection device according to the present invention.

After passing through the fixing unit 30, the sheet P is transported in a direction indicated by an arrow C toward an output unit 18. The output unit 18 feeds the sheet P in a direction indicated by an arrow D and outputs the sheet P onto an output tray 19.

The mechanism of the printer 10, which feeds the sheet P from the sheet tray 21, transports the sheet P through a space between the photoconductor 12 and the transfer unit 16 and through the fixing unit 30, and outputs the sheet P onto the output tray 19 corresponds to an example of a transport device according to the present invention.

Figure 2:
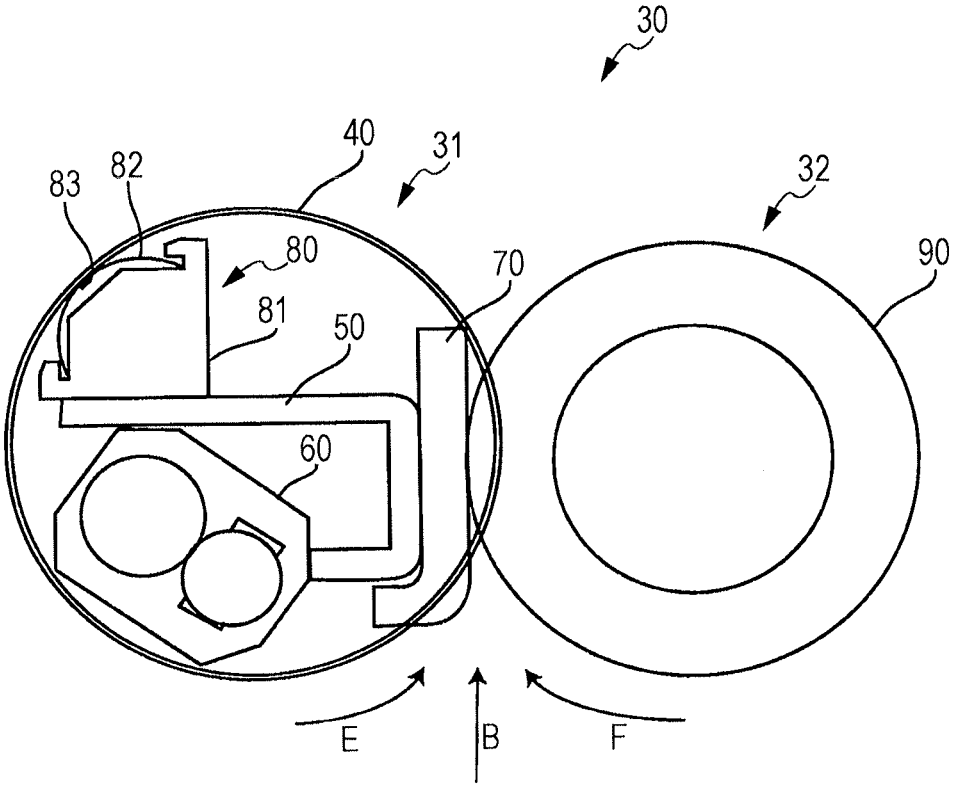
FIG. 2 is a cross-sectional view of a fixing unit.

FIG. 2 is a cross-sectional view of the fixing unit 30.

The fixing unit 30 includes a heating unit 31 and a pressing unit 32. The heating unit 31 corresponds to an example of a heating device according to the present invention. The pressing unit 32 corresponds to an example of a pressing device according to the present invention.

The heating unit 31 includes an endless heating belt 40. The heating unit 31 includes a supporting member 50, a heating lamp 60, a nip member 70, and a temperature detection unit 80, which are disposed inside the heating belt 40. The heating belt 40 corresponds to an example of an object to be detected according to the present invention. The temperature detection unit 80 corresponds to an example of a temperature detection device according to the present invention.

The supporting member 50 extends in the direction perpendicular to the plane of FIG. 2. Both end portions of the supporting member 50, which protrude from both edges of the heating belt 40, are supported by a housing of the printer 10 (FIG. 1). The supporting member 50 serves as a supporting base for supporting other members disposed inside the heating belt 40.

The heating lamp 60, which is supported by the supporting member 50, has a function of heating the heating belt 40.

The nip member 70 has a function of receiving a pressing force applied from a pressing roller 90 when the heating belt 40 is pressed by the pressing roller 90 (described below).

In FIG. 2, a part of the nip member 70 extends beyond the outline of the heating belt 40, because FIG. 2 illustrates the heating belt 40 in its original shape when there is no interference between the heating belt 40 and the nip member 70 and the like. In reality, the nip member 70 is disposed inside the heating belt 40, and the heating belt 40 is pressed by the pressing roller 90 and deformed so as to have a shape corresponding to the shape of the nip member 70 as described below.

The temperature detection unit 80 is also fixed to the supporting member 50. The temperature detection unit 80 includes a base 81, a supporting body 82, and plural temperature detection elements 83 (see FIG. 5). The structure of the temperature detection unit 80 will be described in detail below.

The pressing unit 32 of the fixing unit 30 includes the pressing roller 90. As described above, the pressing roller 90 presses the heating belt 40 against the nip member 70. The pressing roller 90 has a surface layer made of a rubber. A part of the pressing roller 90 that presses the heating belt 40 against the nip member 70 is deformed so as to have a shape corresponding to the shape of a surface of the nip member 70 with the heating belt 40 therebetween. Accordingly, a region of the heating belt 40 nipped between the nip member 70 and the pressing roller 90 is deformed so as to have a shape corresponding to the shape of the surface of the nip member 70.

The pressing roller 90 rotates in a direction indicated by an arrow F while pressing the heating belt 40 against the nip member 70. As the pressing roller 90 rotates, the heating belt 40 is rotated in a direction indicated by an arrow E.

After the transfer unit 16 illustrated in FIG. 1 has transferred the toner image to the sheet P, the sheet P is transported in the direction of the arrow B shown in FIGS. 1 and 2 to the fixing unit 30. The sheet P is heated and pressed between the heating belt 40 and the pressing roller 90, and thereby the toner image is fixed onto the sheet P. After an image, which is a fixed toner image, has been formed on the sheet P, the sheet P is transported in the direction of the arrow C shown in FIG. 1 and is output by the output unit 18 in the direction of arrow D onto the output tray 19.

Figure 3:
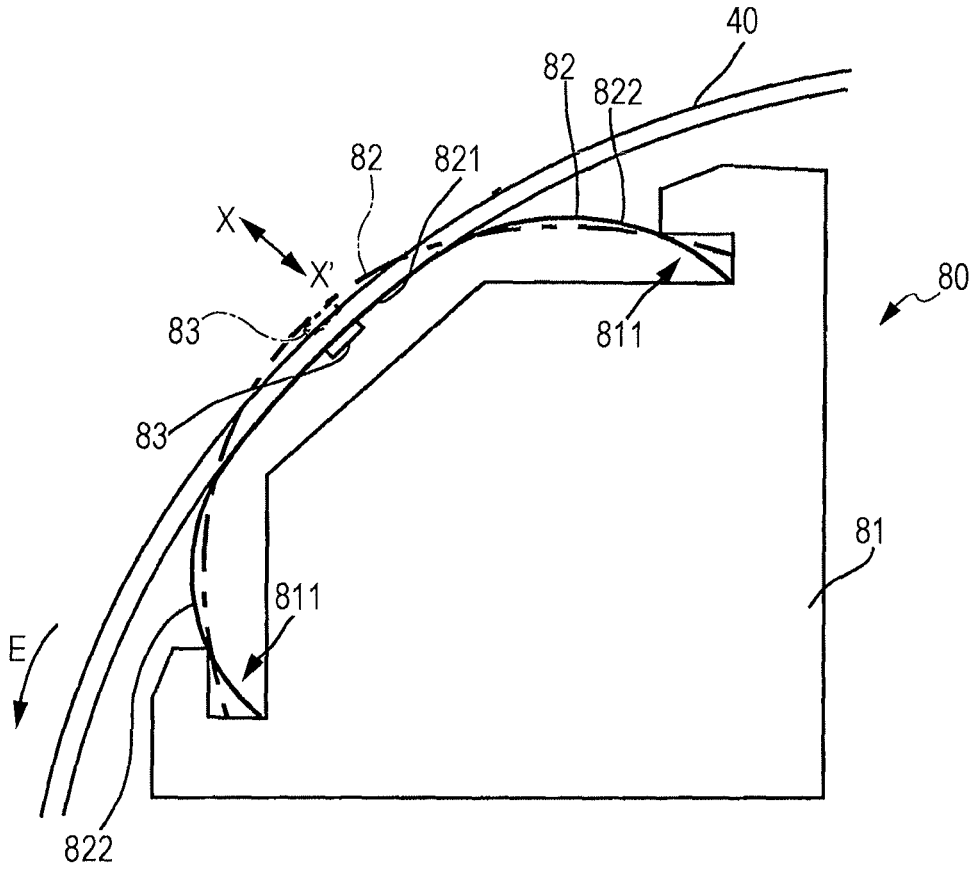
FIG. 3 is an enlarged cross-sectional view of a temperature detection unit.

FIG. 3 is an enlarged view of the temperature detection unit 80.

As described above, the temperature detection unit 80 includes the base 81, the supporting body 82, and the temperature detection elements 83.

The base 81 is made of a resin and fixed to the supporting member 50 shown in FIG. 2.

In the present exemplary embodiment, the supporting body 82 includes a substrate that is a resin sheet made of, for example, a polyimide resin. The supporting body 82 is supported by the base 81 in such a way that two ends of the supporting body 82 in the cross section shown in FIG. 3, that is, the upstream end and the downstream end of the supporting body 82 in the direction in which the heating belt 40 rotates (the direction of the arrow E) are inserted into grooves 811 in the base 81. A middle portion of the supporting body 82 bulges in an arc shape toward the heating belt 40. In FIG. 3, the supporting body 82 is represented by a chain line and a solid line. The chain line represents the supporting body 82 in its initial shape when the supporting body 82 does not receive an external force from the heating belt 40. In the initial shape, the supporting body 82 bulges in an arc shape to a position beyond the heating belt 40. The solid line represents the supporting body 82 when the supporting body 82 is elastically deformed by being pressed by the heating belt 40.

The supporting body 82, which is represented by the solid line, is pressed inward by the heating belt 40. As a result, a middle portion 821 of the supporting body 82 contacts an inner surface of the heating belt 40; and shoulder portions 822 of the supporting body 82, on both sides of the middle portion 821, extend outward from the outline of the supporting body 82 when an external force is not applied from the heating belt 40, which is represented by the chain line. The shapes of the shoulder portions 822 in this state may be controlled by changing the shapes of the grooves 811 of the base 81 for holding the supporting body 82.

The heating belt 40 rotates in the direction of the arrow E, as described with reference to FIG. 2. As the heating belt 40 rotates, the heating belt 40 becomes displaced in the direction indicted an arrow X-X' shown in FIG. 3. Because the supporting body 82 is elastically deformed by being pressed by the heating belt 40, even when the heating belt 40 becomes displaced in the direction of the arrow X-X', the supporting body 82 becomes deformed in accordance with the displacement of the heating belt 40 and continues to be in contact with the inner surface of the heating belt 40.

Each of the temperature detection elements 83 is fixed to a contact portion of the supporting body 82 that contacts the heating belt 40, that is, the vertex of the arc shape of the supporting body 82 that bulges. In the present exemplary embodiment, the temperature detection element 83 is mounted on a back surface of the contact portion of the supporting body 82, the back surface being opposite to a contact surface that contacts the heating belt 40. In the present exemplary embodiment, a thermistor is used as the temperature detection element 83.

As described above, the supporting body 82 is supported by the base 81 in such a way that the upstream end and the downstream end of the supporting body 82 in the direction in which the heating belt 40 rotates (the direction of the arrow E in FIG. 2) are supported by the base 81. The supporting body 82 bulges in an arc shape and is in contact with the heating belt 40. Each of the temperature detection elements 83 is mounted on a portion of the supporting body 82 at the vertex of the arc shape. Therefore, even when the heating belt 40 is displaced in the direction of the arrow X-X', a portion of the supporting body 82 on the upstream side of the vertex, on which the temperature detection element 83 is mounted, and a portion of the supporting body 82 on the downstream side of the vertex are uniformly deformed. Thus, even when the heating belt 40 is displaced in the direction of arrow X-X', the position and the orientation of the temperature detection element 83 with respect to the heating belt 40 do not change. Accordingly, the temperature detection element 83 detects the temperature of the heating belt 40 with a constant sensitivity regardless of the displacement of the heating belt 40.

In the present exemplary embodiment, the supporting body 82 includes a substrate that is a resin sheet.

The shape and the material of the supporting body 82 differ from those of existing devices. The supporting body of existing devices is not made from a resin sheet but is made from a metal plate. A supporting body made from a metal plate tends to have a larger thermal capacity and a higher thermal conductivity.

In recent years, heating belts having a small thermal capacity (which are easily heated and cooled) have been increasingly used for energy saving. Accordingly, when detecting the temperature of the heating belt 40 having a small thermal capacity, if the supporting body 82 draws heat from the heating belt 40, detection error might increase.

In this respect, in the present exemplary embodiment, because a resin sheet is used as the substrate of the supporting body 82, the supporting body 82 draws only a small amount of heat, so that it is possible to detect the temperature of the heating belt 40, which has a small thermal capacity, with high accuracy.

Figure 4:
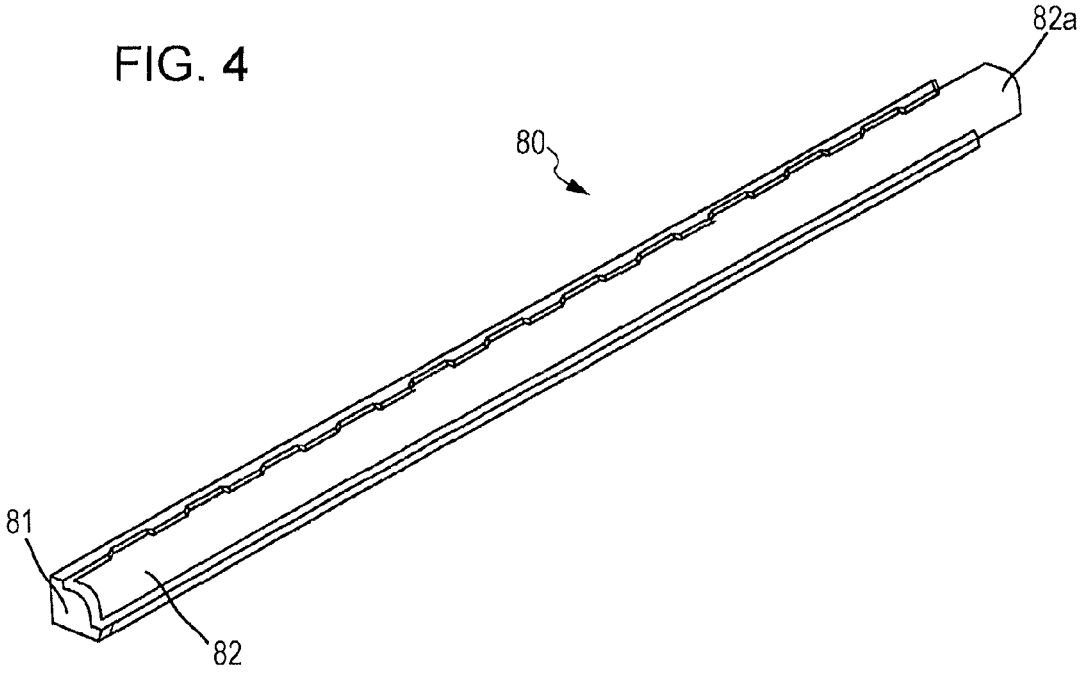
FIG. 4 is a perspective view of the temperature detection unit.

FIG. 4 is a perspective view of the temperature detection unit 80.

The base 81 of the temperature detection unit 80 has such a shape that the base 81 extends in the axial direction of the heating belt 40 shown in FIGS. 1 and 2 while having a cross-sectional shape shown in FIGS. 2 and 3. The axial direction is perpendicular to the planes of FIGS. 1 and 2. The base 81 has a length that is substantially the same as the distance between the edges of the heating belt 40 in the axial direction.

The supporting body 82, which is supported by the base 81, has a length that is larger than that of the base 81 in the axial direction of the heating belt 40. One end portion 82*a* of the supporting body 82 protrudes from an end of the base 81. The supporting body 82, which is supported by the base 81 and bulges in an arc shape, is pressed against the inner surface of the heating belt 40 uniformly over the entire width of the heating belt 40 in the axial direction.

Figure 5:
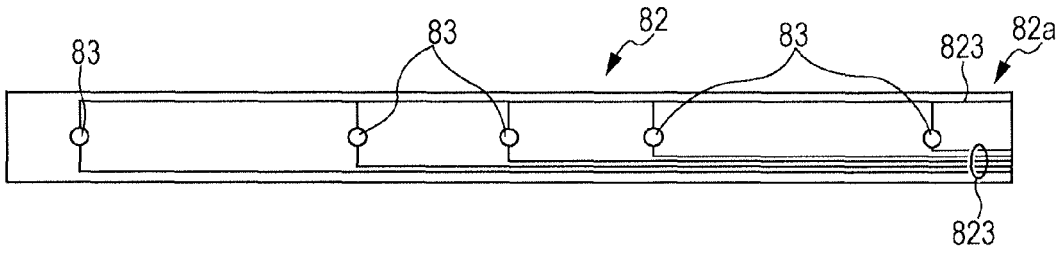
FIG. 5 is a development view of a supporting body.

FIG. 5 is a development view of the supporting body 82. FIG. 5 illustrates the back surface of the supporting body 82, which is opposite to the contact surface of the supporting body 82 that contacts the heating belt 40.

As described above, the supporting body 82 includes the substrate that is a resin sheet. The temperature detection elements 83 (in this example, five temperature detection elements 83) are mounted on the supporting body 82 at different positions in the longitudinal direction of the supporting body 82 (the axial direction of the heating belt 40). This is in order to detect the temperatures of plural portions of the heating belt 40 in the axial direction.

In the present exemplary embodiment, plural wires 823, which are connected to the temperature detection elements 83, are disposed on the supporting body 82. The supporting body 82 is made by using a method for making a flexible printed circuit.

One end portion 82*a* of the supporting body 82 protrudes from the base 81 and further protrudes from one of the side edges of the heating belt 40. The wires 823 on the supporting body 82 are connected to wires, which extend from a circuit (not shown), at the end portion 82*a* protruding from one of the side edges of the heating belt 40. When the temperature of the heating belt 40 detected by the temperature detection elements 83 reaches a predetermined high temperature or higher, the circuit (not shown) performs control operations to be performed for the high temperature, such as stopping supply of electric power to the heating lamp 60 (see FIG. 2) and stopping the rotation of the pressing roller 90.

The wires 823 are disposed on the back surface of the supporting body 82, which is opposite to the contact surface of the supporting body 82 that contacts the heating belt 40. The temperature detection elements 83 are mounted also on the back surface of the supporting body 82. Therefore, only the resin sheet, which is the substrate of the supporting body 82, uniformly contacts the heating belt 40. Thus, with the present exemplary embodiment, wear and scratch of the heating belt 40 are suppressed.

In the present exemplary embodiment, the wires 823 are disposed on the resin sheet so as to be integrated with the supporting body 82. Therefore, it is not necessary to use a wire harness that is independent from the supporting body 82, and thereby the number of components is reduced and the cost of manufacturing the temperature detection unit 80 is reduced.

In the example described above, the temperature detection unit 80 is used to detect the temperature of the heating belt 40 of the fixing unit 30 of the printer 10 illustrated in FIG. 1. A temperature detection device according to the present invention may be used not only to detect the temperature of the heating belt 40 but also to detect the temperature of a more general object. A temperature detection device according to the present invention may be used not only in the fixing unit 30 having the structure illustrated in FIG. 3 and the printer 10 having the structure illustrated in FIG. 1 but also in any apparatus including an object whose temperature needs to be detected.

The foregoing description of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A temperature detection device comprising:

a supporting body that includes end portions and a middle portion and that is elastically deformed by being pressed by an object to be detected, both of the end portions being supported at positions separated from the object to be detected, the supporting body having an initial shape such that the middle portion bulges in an arc shape to a position beyond the object to be detected when the supporting body does not receive an external force from the object to be detected; and a temperature detection element that is supported by a contact portion of the supporting body that contacts the object to be detected.

2. The temperature detection device according to claim 1, wherein the supporting body includes a substrate that is a resin sheet.

3. The temperature detection device according to claim 2, wherein the temperature detection element is mounted on a back surface of the contact portion of the supporting body, the back surface being opposite to a contact surface that contacts the object to be detected.

4. The temperature detection device according to claim 3, wherein the object to be detected is an endless belt that rotates, wherein the resin sheet is disposed inside the object to be detected and includes an upstream end portion, a middle portion, and a downstream end portion with respect to a direction in which the object to be detected rotates, both of the end portions being supported so as to be separated from the object to be detected, the middle portion bulging in an arc shape and having a shape such that the arc shape extends in an axial direction of the endless belt, and wherein the supporting body includes a wire that is disposed on the resin sheet and that is connected to the temperature detection element.

5. The temperature detection device according to claim 4, wherein a plurality of the temperature detection elements are disposed at positions on the supporting body that differ from each other in the axial direction.

6. The temperature detection device according to claim 2, wherein the object to be detected is an endless belt that rotates, wherein the resin sheet is disposed inside the object to be detected and includes an upstream end portion, a middle portion, and a downstream end portion with respect to a direction in which the object to be detected rotates, both of the end portions being supported so as to be separated from the object to be detected, the middle portion bulging in an arc shape and having a shape such that the arc shape extends in an axial direction of the endless belt, and wherein the supporting body includes a wire that is disposed on the resin sheet and that is connected to the temperature detection element.

7. The temperature detection device according to claim 6, wherein a plurality of the temperature detection elements are disposed at positions on the supporting body that differ from each other in the axial direction.

8. A fixing device comprising:

a heating device including an endless heating belt that rotates;

a pressing device that nips a sheet, which has a powder image thereon and which is transported to the pressing device, between the pressing device and the heating belt and presses the sheet against the heating belt; and the temperature detection device according to claim 1 for which the object to be detected is the heating belt.

9. An image forming apparatus comprising:

an image forming device that forms a powder image on a sheet transported thereto;

the fixing device according to claim 8; and a transport device that transports the sheet along a transport path that extends through the image forming device and the fixing device.

* * * * *